US005812914A

United States Patent [19]

Johroku

[11] Patent Number: 5,812,914

[45] Date of Patent: Sep. 22, 1998

[54] TONER REPLENISHING DEVICE, SHUTTER MEMBER, AND TONER CARTRIDGE FOR USE THEREIN

[75] Inventor: Kazuo Johroku, Osaka, Japan

[73] Assignee: Mita Industrial Co., Ltd., Osaka, Japan

[21] Appl. No.: 957,708

[22] Filed: Oct. 24, 1997

[30] Foreign Application Priority Data

Nov. 18, 1996 [JP] Japan ..... 8-306839

[51] Int. Cl.[6] ..... G03G 15/08

[52] U.S. Cl. ..... 399/262; 399/252

[58] Field of Search ..... 399/262, 258, 399/254, 252, 222, 119, 106

[56] References Cited

U.S. PATENT DOCUMENTS 5,089,854 2/1992 Kaieda et al. ..... 399/262

5,294,963 3/1994 Nakano et al. ..... 399/106

*Primary Examiner*—Arthur T. Grimley
*Assistant Examiner*—Hoan Tran
*Attorney, Agent, or Firm*—Beveridge, DeGrandi, Weilacher & Young LLP

[57] ABSTRACT

A toner replenishing device including a container having an acceptance opening for a toner, and a toner cartridge removably mounted on the container so as to traverse the acceptance opening along an upper surface portion extending at the upper end of the acceptance opening, and using a shutter member when the toner cartridge is removed from the container. An engaged hole is formed in one side part of the container. In one side part of the shutter member opposed to the one side part of the container, a hook portion is formed for being engaged with the engaged hole to allow the turn of the shutter member in the direction of insertion between the lower surface of the toner cartridge and the upper surface portion of the container, as well as in the reverse direction, and to regulate the position of the shutter member in the width direction relative to the container.

14 Claims, 12 Drawing Sheets

TONER REPLENISHING DEVICE, SHUTTER MEMBER, AND TONER CARTRIDGE FOR USE THEREIN

FIELD OF THE INVENTION

This invention relates to a toner replenishing device, a shutter member, and a toner cartridge for use therein.

DESCRIPTION OF THE PRIOR ART

In an electrostatic copier, an electrostatic printer or an electrostatic facsimile, an electrostatic latent image is formed on an electrostatic photoconductor, and then this latent image is developed to a toner image. A developing device for developing the electrostatic latent image to the toner image comprises a development housing which is a container for accommodating a one-component developer consisting of a toner alone, or a two-component developer composed of a toner and carrier particles; a developer applicator means for conveying the developer accommodated in the development housing to a developing area, and applying it to an electrostatic photoconductor; and a toner replenishing device for replenishing a toner to the development housing.

A typical example of a toner replenishing device normally includes a toner cartridge to be mounted replaceably. The development housing has an acceptance opening for a toner. The toner cartridge is mounted removably on the development housing so as to traverse the acceptance opening along an upper surface portion extending at the upper end of the acceptance opening. On the development housing, a stop means is disposed for inhibiting the toner cartridge mounted on the development housing from being released from the development housing. The stop means is disposed there so as to protrude upward from an upper surface portion at the upstream end in the mounting direction of the toner cartridge. The toner cartridge accommodating the toner inside has an outlet for the toner, and a flange portion formed so as to surround the outlet. The toner cartridge is mounted on the development housing in the above-mentioned manner, with its outlet being aligned with the acceptance opening. To facilitate the mounting of the toner cartridge on the development housing, a pair of channel-shaped guide grooves are generally formed in the width direction (a direction perpendicular to the mounting direction) of the development housing. The corresponding flange portion of the toner cartridge is guided by these guide grooves to be moved in the direction of mounting and removal.

At a time when the toner cartridge is mounted on the development housing, the outlet is sealed with a sheet member bonded to a peripheral edge portion of the outlet. After the toner cartridge is mounted at a required position of the development housing, the sheet member is stripped from the flange portion to unseal the outlet. Thus, the toner accommodated in the toner cartridge is discharged through the outlet, and supplied into the development housing through the acceptance opening.

As development proceeds, the toner is consumed, and the need to replenish a toner to the development housing arises. At this time, the toner cartridge is removed from the development housing, and replaced by a fresh toner cartridge. In removing the toner cartridge from the development housing, a separately prepared shutter member is used. The shutter member is positioned at an operating position at which at least a part of the shutter member is inserted between the lower surface of the toner cartridge and the upper surface of the development housing. As a result, the action of the stop means is cleared. At least this inserted part of the shutter member is shaped like a thin plate. On a peripheral edge portion of the acceptance opening, including the upper surface portion, of the development housing, an elastic seal member of sponge or the like is disposed. The toner cartridge is mounted on (intimately contacted with) the development housing via the seal member. Thus, the shutter member is inserted between the lower surface of the toner cartridge and the upper surface of the development housing by further elastically deforming the seal member.

Then, the toner cartridge is pulled out of the development housing, whereupon the toner cartridge is placed on the shutter member to close the outlet of the toner cartridge with the shutter member. In this condition, the toner cartridge is removed from the upper surface portion of the development housing together with the shutter member. Thereby, the toner cartridge is completely removed from the development housing, with its outlet being closed with the shutter member. Then, a fresh toner cartridge is mounted on the development housing in the aforementioned manner to perform toner cartridge replacement.

The above-described conventional toner replenishing device, however, poses the following problems to be solved:

In removing the toner cartridge from the development housing, an inserting operation is performed for locating the shutter member at the operating position by inserting at least a part of it between the lower surface of the toner cartridge and the upper surface portion of the development housing. The acceptance opening of the development housing is generally rectangular. In a device of the type in which the toner cartridge is mounted on and removed from the development housing in the longitudinal direction of the acceptance opening, the width of the insertion region between the lower surface of the toner cartridge and the upper surface portion of the development housing, and the width of the shutter member are relatively small. Thus, the widthwise alignment of the shutter member with the development housing during the inserting operation is relatively easy. The operation for inserting the shutter member can also be performed relatively easily and smoothly.

In a device of the type in which the toner cartridge is mounted on and removed from the development housing in a transverse direction perpendicular to the longitudinal direction of the acceptance opening, however, the width of the insertion region between the lower surface of the toner cartridge and the upper surface portion of the development housing, and the width of the shutter member are much larger than in the above-described type. This makes difficult the alignment during the shutter member inserting operation. The increases in these widths during the shutter member inserting operation result in a relatively large force required for elastic deformation of the seal member, because the toner cartridge is in intimate contact with the development housing via the seal member. Consequently, it is difficult to perform the inserting operation easily and smoothly. Furthermore, a twist occurs in the seal member during the insertion of the shutter member, thus making it difficult to perform the inserting operation easily and smoothly.

The foregoing problems are not restricted to a toner replenishing device of the above-described type. They are common to other types of toner replenishing devices, e.g., a toner replenishing device of the type in which a toner cartridge is removably mounted on a toner hopper (container) located at a position apart from the development housing.

SUMMARY OF THE INVENTION

An object of the present invention is to provide a novel and improved toner replenishing device which facilitates the alignment of a shutter member during its insertion operation, and which can perform the shutter member inserting operation easily and smoothly, when a toner cartridge is to be removed in the transverse direction of an acceptance opening of a container.

Another object of the invention is to provide a novel and improved shutter member which can be easily aligned during its inserting operation, and which can be inserted easily and smoothly, when a toner cartridge is to be removed in the transverse direction of an acceptance opening of a container.

Still another object of the invention is to provide a novel and improved toner cartridge which can be removed easily and smoothly in the transverse direction of an acceptance opening of a container.

According to an aspect of the invention, there is provided a toner replenishing device comprising a container having an acceptance opening for a toner; and a toner cartridge removably mounted on the container so as to traverse the acceptance opening along an upper surface portion extending at the upper end of the acceptance opening, and having an outlet for supplying a toner accommodated therein into the container through the acceptance opening; the container having a stop means disposed thereon for inhibiting the toner cartridge mounted on the container from being released from the container, the stop means being disposed so as to protrude upward from the upper surface portion at the upstream end in the mounting direction of the toner cartridge;

the toner replenishing device further including a shutter member constituted such that when the toner cartridge is to be removed from the container, a front end of the shutter member is inserted between the lower surface of the toner cartridge and the upper surface portion of the container to bring the shutter member to an operating position, thereby clearing the action of the stop means, permitting the removal of the toner cartridge while closing the outlet of the toner cartridge; wherein one of engaging means and engaged means to be releasably engaged with each other is formed for making the shutter member turnable in the inserting direction and in the reverse direction and for regulating the widthwise position of the shutter member relative to the container, the one of the engaging means and the engaged means being disposed in one side part of the upstream end of the container in the mounting direction of the toner cartridge, and the other of the engaging means and the engaged means is formed in one side part of the front end of the shutter member in the inserting direction.

According to another aspect of the invention, there is provided a shutter member in a toner replenishing device, the toner replenishing device comprising a container having an acceptance opening for a toner; and a toner cartridge removably mounted on the container so as to traverse the acceptance opening along an upper surface portion extending at the upper end of the acceptance opening, and having an outlet for supplying a toner accommodated therein into the container through the acceptance opening; the container having a stop means disposed thereon for inhibiting the toner cartridge mounted on the container from being released from the container, the stop means being disposed so as to protrude upward from the upper surface portion at the upstream end in the mounting direction of the toner cartridge;

the shutter member being constituted such that when the toner cartridge is to be removed from the container, a front end of the shutter member is inserted between the lower surface of the toner cartridge and the upper surface portion of the container to bring the shutter member to an operating position, thereby clearing the action of the stop means, permitting the removal of the toner cartridge while closing the outlet of the toner cartridge;

one of engaging means and engaged means to be releasably engaged with each other being formed in one side part of the upstream end of the container in the mounting direction of the toner cartridge; wherein the other of the engaging means and engaged means is formed in one side part of the front end of the shutter member in the inserting direction, and is engaged with the one of the engaging means and engaged means to make the shutter member turnable in the inserting direction and in the reverse direction and regulate the widthwise position of the shutter member relative to the container.

According to still another aspect of the invention, there is provided a toner cartridge mounted on a container, the container having an acceptance opening for a toner and stop means disposed so as to protrude upward from an upper surface portion at one end site of the upper surface portion extending at the upper end of the acceptance opening, the container also having one of engaging means and engaged means to be engaged with each other releasably; the one of the engaging means and the engaged means making a shutter member turnable in an inserting direction toward the upper surface portion of the container and along it, and in the reverse direction, and regulating the position of the shutter member in the width direction relative to the container; the shutter member being prepared as a member separate from the container, and having the other of the engaging means and engaged means formed in one side part thereof, the one of the engaging means and engaged means being formed in one side part of the container opposed to the one side part of the shutter member, the toner cartridge being removably mounted on the container so as to traverse the acceptance opening along the upper surface portion of the container, being inhibited by the stop means from being released from the container, and having an outlet for supplying a toner accommodated therein into the container through the acceptance opening, wherein the toner cartridge has a lower surface opposed to the upper surface portion of the container when mounted on the container, when the shutter member is turned in the inserting direction to an operating position at which a front end of the shutter member is inserted between the lower surface of the toner cartridge and the upper surface portion of the container, the action of the stop means is cleared so that the toner cartridge can be pulled out onto the shutter member, and when the toner cartridge is pulled out onto the shutter member, the toner cartridge is turned in a direction opposite to the inserting direction, along with the shutter member, and removed from the container, with the outlet of the toner cartridge being closed.

DETAILED DESCRIPTION OF THE PREFERRED EMBODIMENTS

Figure 1:
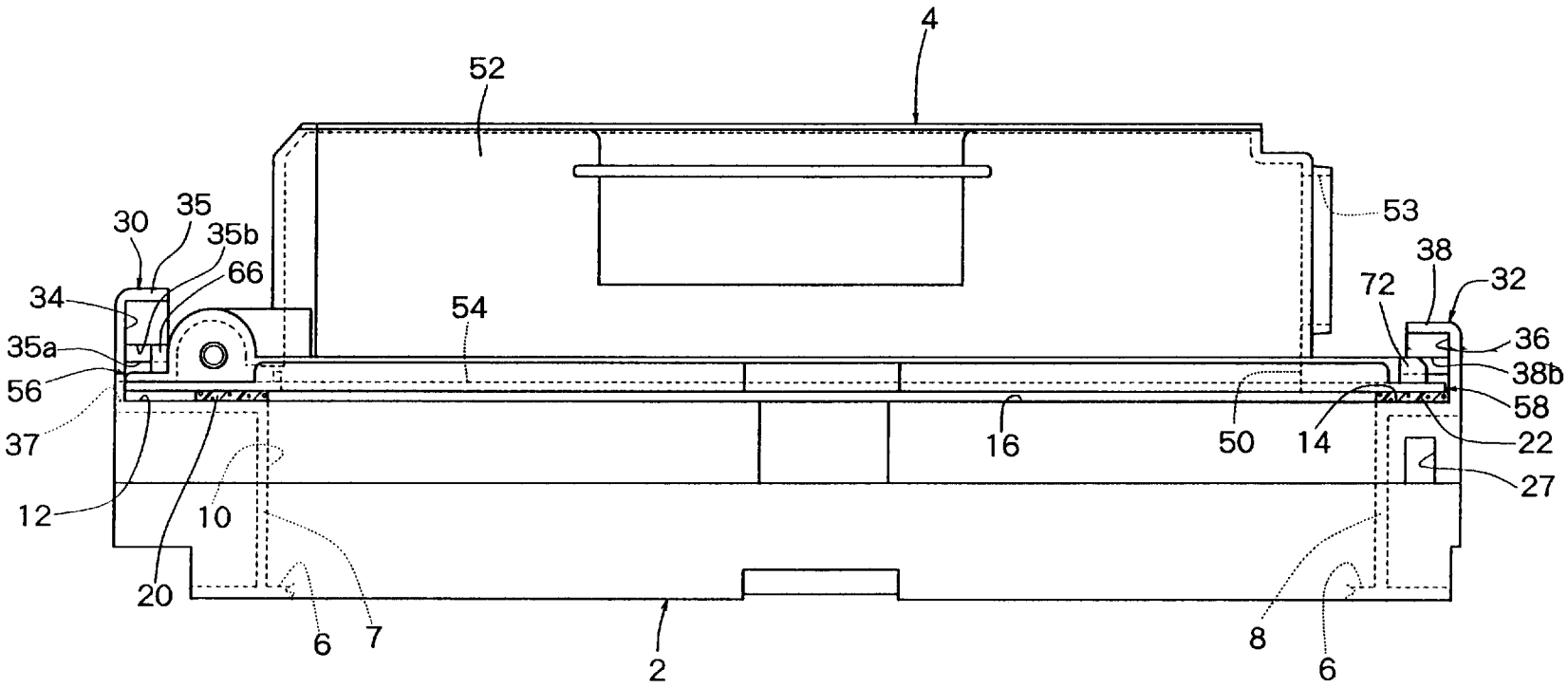
FIG. 1 is a front view showing a preferred embodiment of a toner replenishing device constructed in accordance with the present invention.

A preferred embodiment of a toner replenishing device constructed in accordance with the present invention will be described in detail by reference to the appended drawings.

Referring to FIGS. 1 to 5, a toner replenishing device illustrated there comprises a development housing designated entirely by the numeral 2, and a toner cartridge 4 to be mounted replaceably on the development housing 2. The development housing 2 constitutes a part of the development housing of an entire developing device (not shown). The developing device comprises the development housing 2 which is a container accommodating a toner and being supplied with a toner from the toner cartridge 4; agitating/conveying means (not shown) for agitating and conveying the toner accommodated in the development housing 2 to other development housing (not shown; constituting a developing chamber); and developer applicator means (not shown) for conveying the toner accommodated in the other development housing to a developing region and applying it to an electrostatic photoconductor.

The development housing 2 comprises a container elongated in the width direction (in a right-and-left direction in FIG. 2) and integrally molded from a suitable plastic material. The development housing 2 has a nearly arcuate bottom wall 6, vertical walls 7 and 8 formed at both ends in the width direction, and an acceptance opening 10 for a toner formed in an upper part thereof. The acceptance opening 10 is substantially rectangular when viewed from above. In both side parts in the width direction of its upper end and in a rear part (lower part in FIG. 2) in the front-to-back direction (in the up-and-down direction in FIG. 2), substantially horizontally extending upper surface portions 12, 14 and 16, respectively, are formed along the upper edge of the acceptance opening 10. The upper surface portions 12 and 14 are positioned on one side (left side in FIG. 2) and the other side (right side in FIG. 2), respectively, of the development housing 2, while the upper surface portion 16 is positioned in a rear part of the development housing 2. The upper surface portions 12, 14 and 16 are positioned on substantially the same horizontal plane. A front part (upper part in FIG. 2) of the upper end of the acceptance opening 10 is defined by a front wall 18 extending linearly in the width direction. Between the front wall 18 and the upper end of a front part of the bottom wall 6, a predetermined gap is formed so that a toner is supplied through the gap by the agitating/conveying means (not shown) mounted above the bottom wall 6 into the other development housing (not shown) disposed forward of the gap.

On the upper surface portions 12, 14 and 16, elastic seal members 20, 22 and 24 are mounted by adhesion. The seal members 20, 22 and 24 each have a predetermined thickness, are elongated and rectangular, and are formed of sponge. In the front wall 18, a concave 28 extending in the width direction is formed, and a seal member 29 composed of sponge (omitted in FIG. 5) is mounted in the concave 28. The upper surface portion 16 positioned at the upstream end in the mounting direction of the toner cartridge 4 (the direction from below to above in FIG. 2) and/or the seal member 24 mounted thereon are or is preferably inclined such that their or its rear parts or part partially lower or lowers rearward. This constitution has the function to smoothly perform the mounting or insertion of the toner cartridge 4 or shutter member 80 to be described later on. At a rear part of the development housing 2, an end wall 26 is formed. The end wall 26 extends downward from the upper surface portion 16, and extends linearly in the width direction. Near the other side part in the width direction of the end wall 26, a substantially rectangular notch 27 (constituting engaged means) is formed. The notch 27 is disposed to temporarily regulate the operating position of the shutter member 80 to be described later on.

Figure 3:
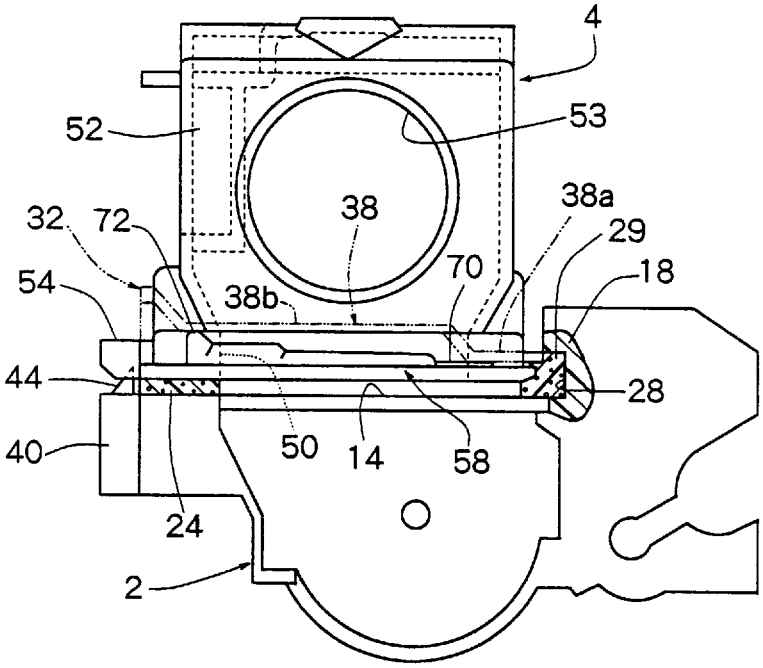
FIG. 3 is a side view, partly broken away, of FIG. 1 as viewed from the right.
Figure 4:
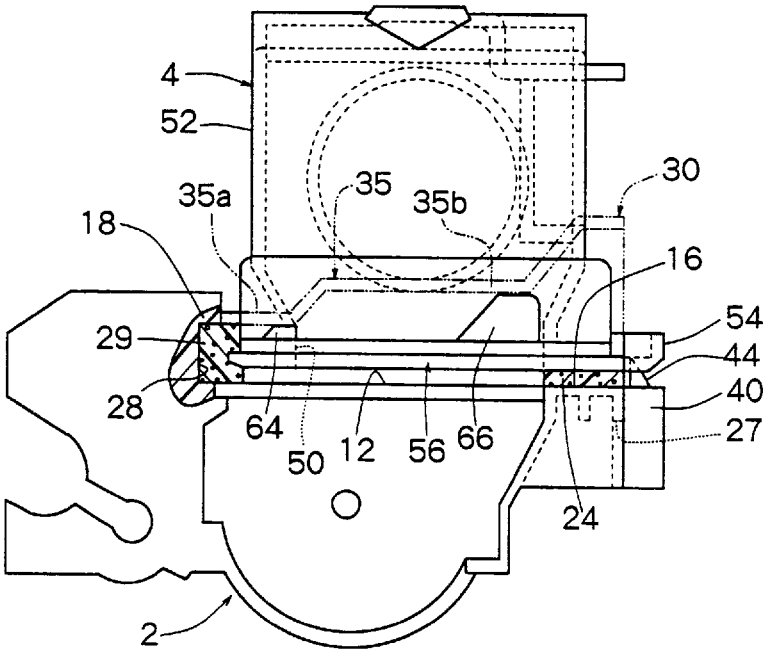
FIG. 4 is a side view, partly broken away, of FIG. 1 as viewed from the left.
Figure 5:
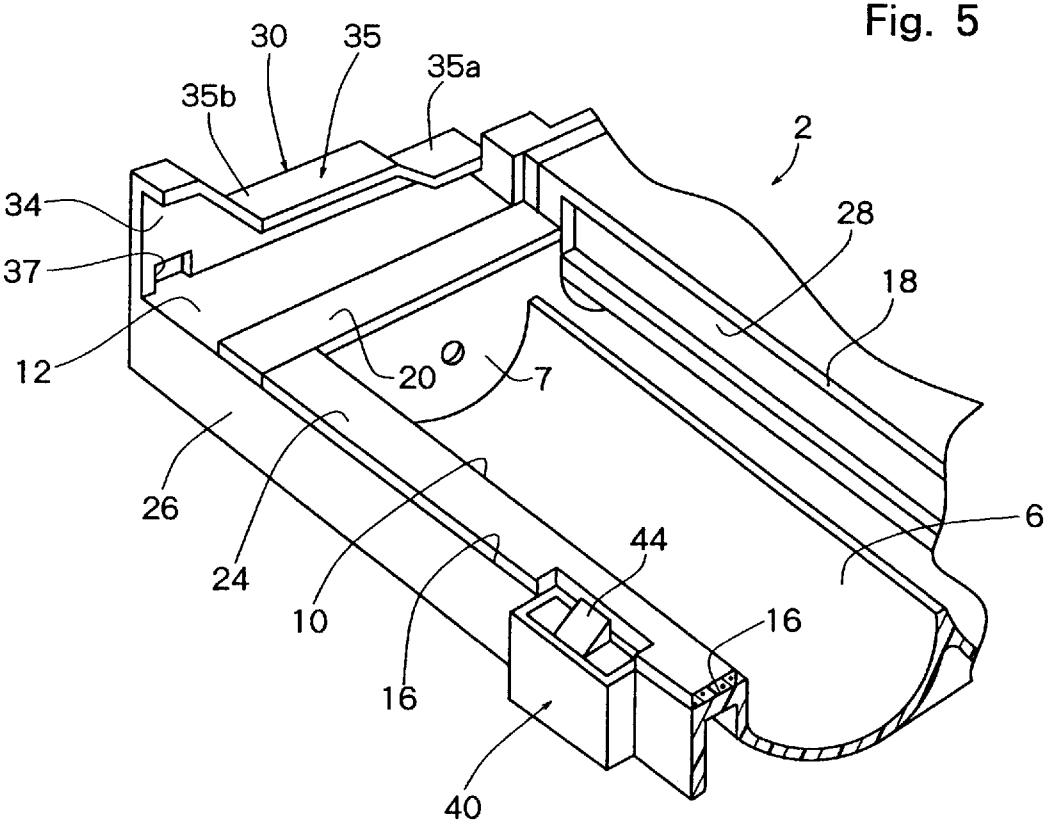
FIG. 5 is a perspective view, partly broken away, of a part of a development housing included in the toner replenishing device illustrated in FIG. 1.
Figure 6:
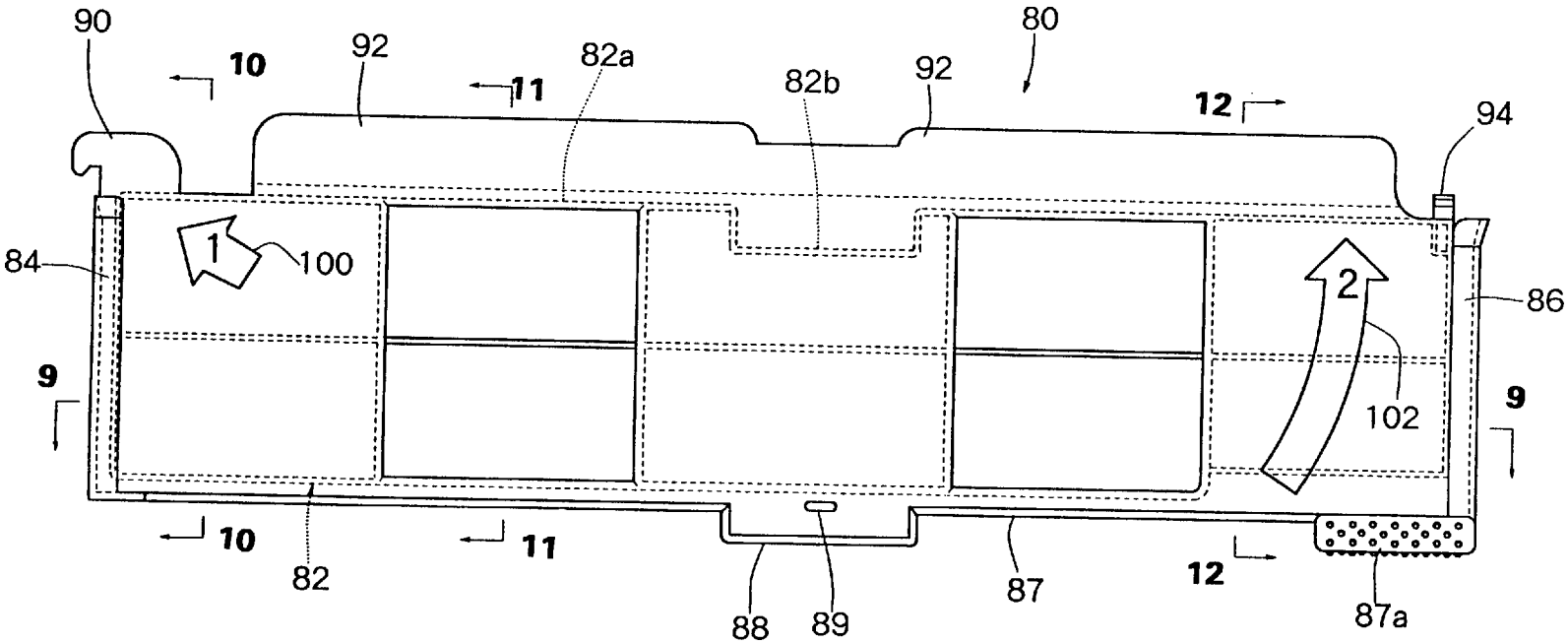
FIG. 6 is a plan view of a shutter member to be applied to the toner replenishing device illustrated in FIG. 1.
Figure 7:
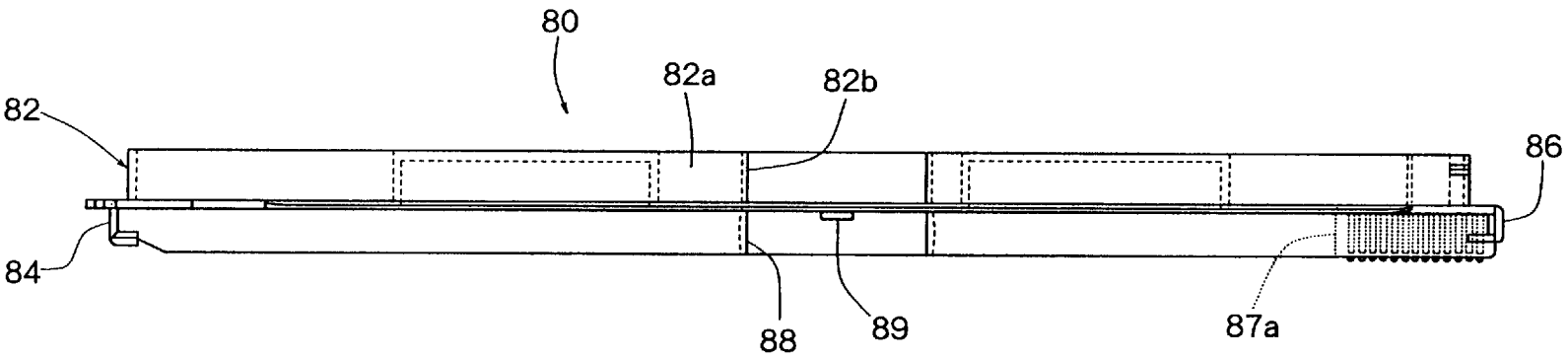
FIG. 7 is a side view of FIG. 6 as viewed from above.
Figure 8:
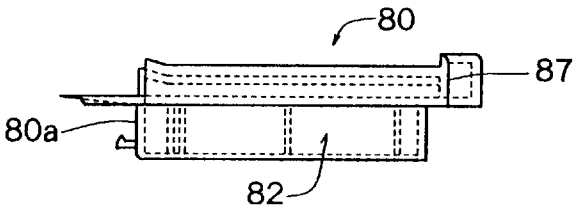
FIG. 8 is a side view of FIG. 6 as viewed from the left.
Figure 9:
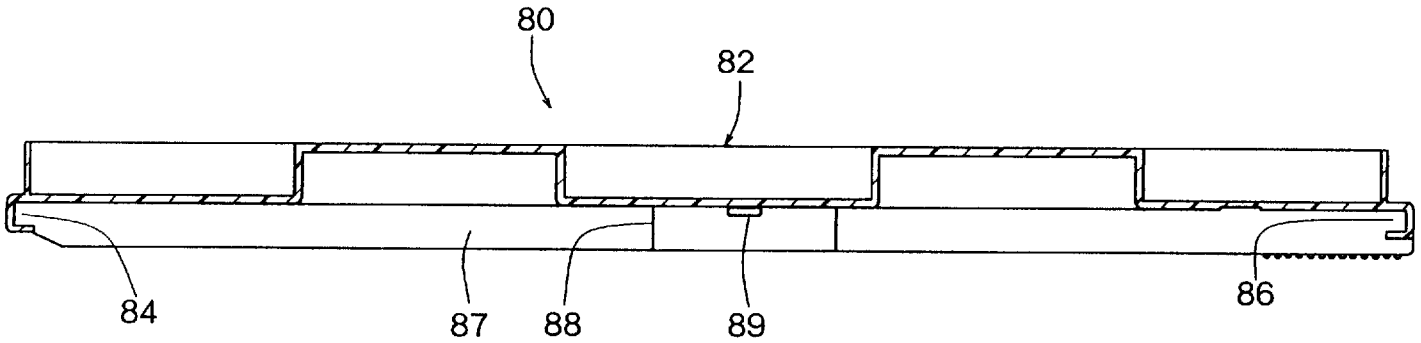
FIG. 9 is a view taken on line 9—9 of FIG. 6.
Figure 10:
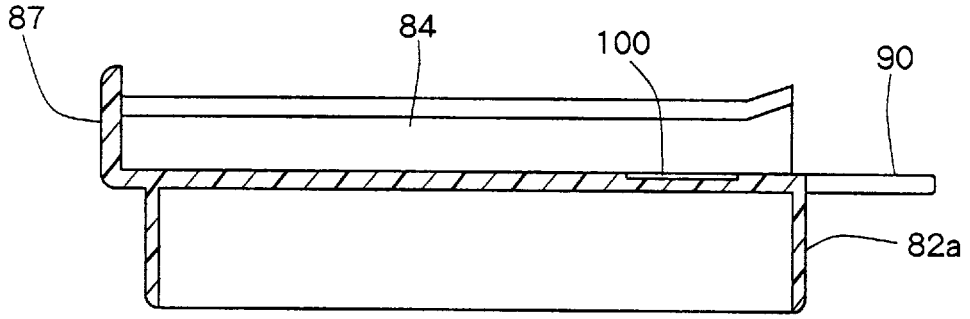
FIG. 10 is a view taken on line 10—10 of FIG. 6.
Figure 11:
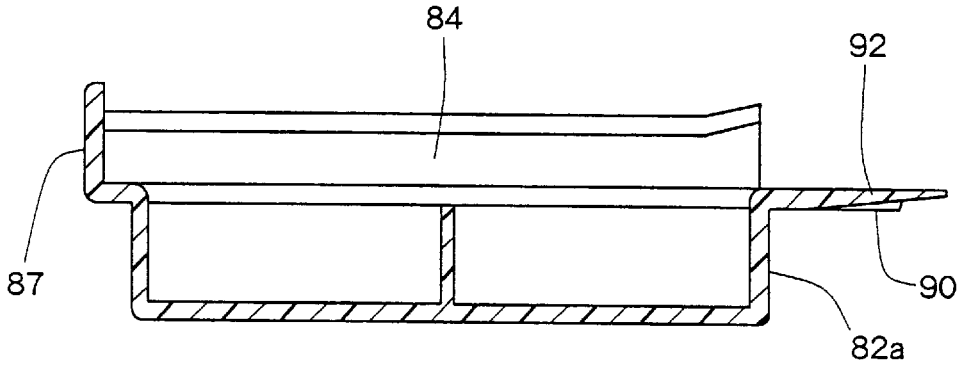
FIG. 11 is a view taken on line 11—11 of FIG. 6.
Figure 12:
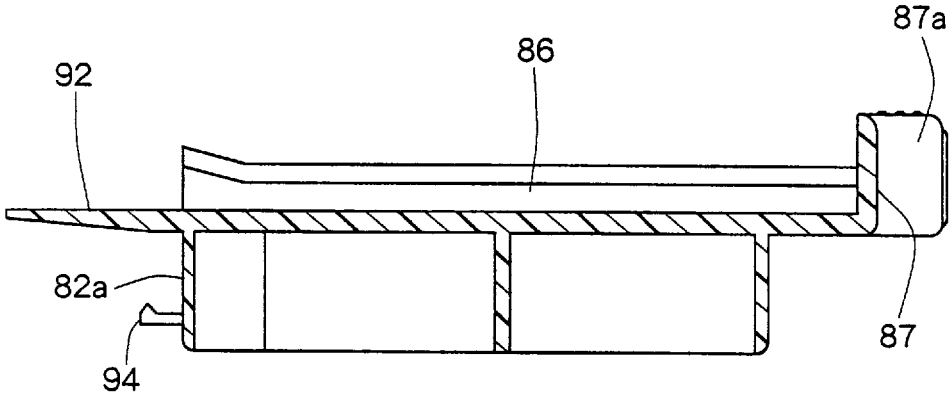
FIG. 12 is a view taken on line 12—12 of FIG. 6.

At one side part and the other side part in the width direction of the development housing 2, channel-like guide grooves 30 and 32, guide means for smooth mounting and removal of the toner cartridge 4 to be described later on, are formed so as to extend in the front-to-back direction. The open portions of the guide grooves 30 and 32 face each other. The guide groove 30 includes a side wall 34 extending vertically upward from an outer side part of the upper surface portion 12, and an upper wall 35 extending inward from the upper end of the side wall 34. As shown in FIGS. 4 and 5, the upper wall 35 includes two upper walls **35*a* and 35*b* having different heights, with the forward upper wall 35*a* being formed at a lower level than the rearward upper wall 35*b*. The guide groove 32 includes a side wall 36 extending vertically upward from an outer side part of the upper surface portion 14, and an upper wall 38 extending inward from the upper end of the side wall 36. As shown in FIG. 3, the upper wall 38 also includes two upper walls 38*a* and 38*b* having different heights, with the forward upper wall 38*a* being formed at a lower level than the rearward upper wall 38*b***.

Figure 2:
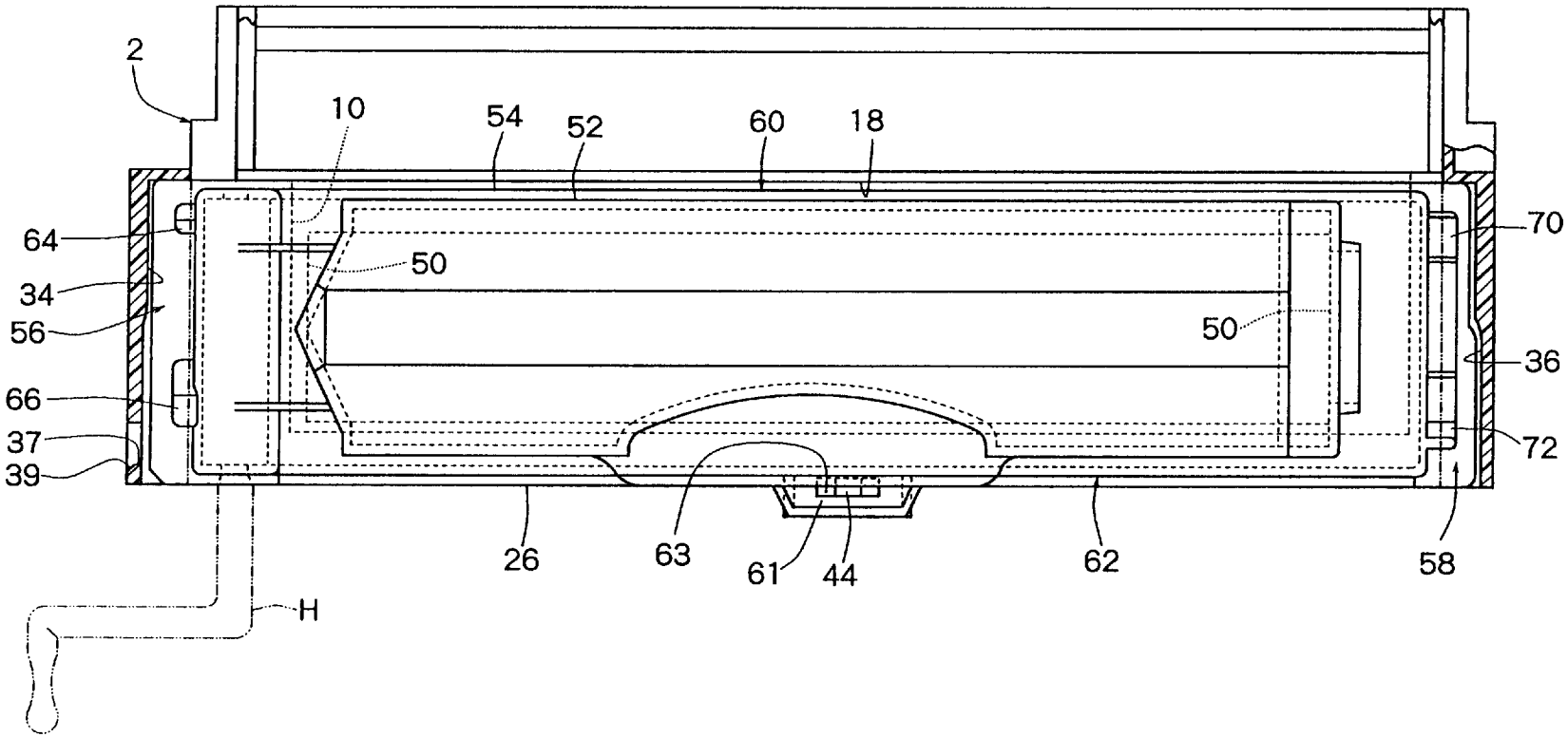
FIG. 2 is a plan view showing, in a partly broken away manner, the toner replenishing device illustrated in FIG. 1.
Figure 13:
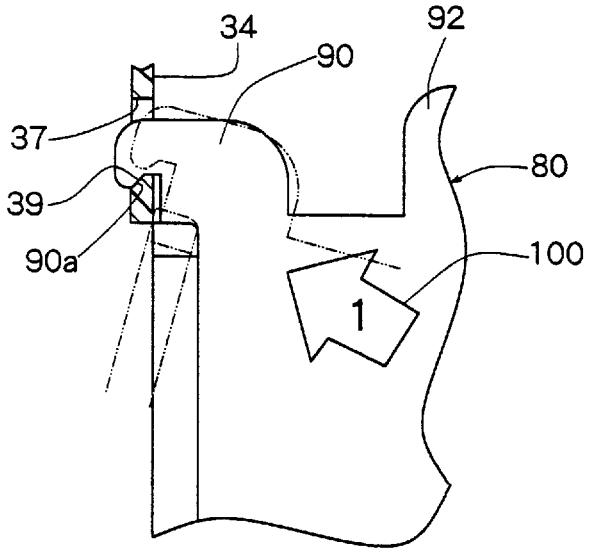
FIG. 13 is a partial view showing the state of engagement between an engaged hole of the development housing and a hook portion of the shutter member.

In a rear part of the side wall 34 (the upstream end part in the mounting direction of the toner cartridge 4), an engaged hole 37 is formed for constituting engaged means. The engaged hole 37 is rectangular, and its lower end face is positioned on substantially the same plane as the upper surface portion 12. As shown in FIGS. 2 and 13, the vertical surface of the rear side of the engaged hole 37 has an incline surface 39 formed in a laterally outer part of the development housing 2.

Figure 16:
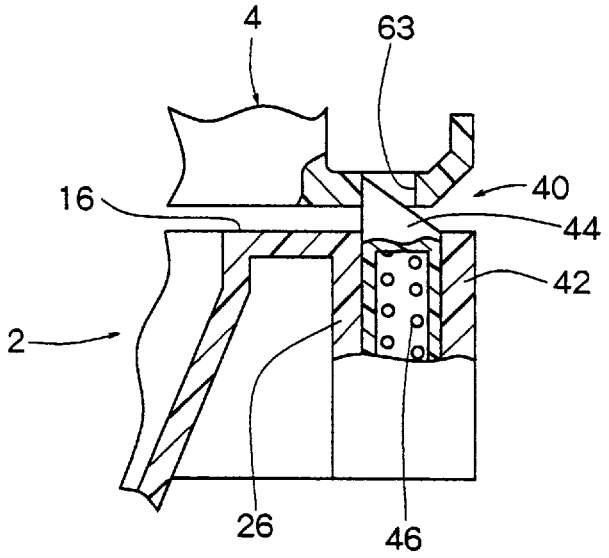
FIG. 16 is a sectional view showing the state of engagement between a lock claw member and an engaged hole.

In a rear part of the development housing 2, stop means (lock means) 40 is disposed for inhibiting the release of the toner cartridge 4 mounted on the development housing 2. The stop means 40, as shown in FIGS. 5 and 16, is formed on the end wall 26, and comprises a box portion 42 open upward, a lock claw member 44 disposed so as to be movable up and down in the box portion 42, and a spring 46 for urging the lock claw member 44 upward. The box portion 42 protrudes rearward in a rectangular form when viewed from above. The lock claw member 44 is always urged by the spring 46 to an operating position at which it protrudes upward in a predetermined amount from the upper surface portion 16. Between the lock claw member 44 and the box portion 42, upward movement inhibiting means (not shown) is disposed for regulating the operating position of the lock claw member 44. The front end of the lock claw member 44 forms a vertical surface, while its upper end forms an inclined surface lowering rearward.

The toner cartridge 4 is composed of an elongated box-shaped housing 52 having an outlet 50 for a toner in a lower part thereof, and a lower cover member 54 having a flat plate-shaped body fixed below the housing 52. The housing 52 and the lower cover member 54 are each integrally molded from a suitable plastic material, and are bonded together by high frequency welding. Although not shown, the outlet 50 substantially rectangular is sealed with a sheet member bonded to a flat surface formed around the lower end thereof. The sheet member is folded back at one end in the width direction. The other end thereof extending in a form overlapping the bonded area is connected to a rotating shaft (not shown) disposed rotatably in one side part of the housing 52. The lower cover member 54 is fixed to the housing 52 so as to cover the sheet member from below. In the lower cover member 54, an outlet aligning with the outlet 50 is formed, although this is not clearly shown.

When the toner cartridge 4 is to be mounted on the development housing 2, the outlet 50 is sealed with the sheet member. In this state, a toner is filled into the toner cartridge 4 through a through-hole 53 formed in the housing 52. After the toner is filled into the toner cartridge 4, the through-hole 53 is closed with a closure member (not shown). Then, the toner cartridge 4 is mounted at a required position of the development housing 2 as will be described later on. Then, the sheet member is stripped off to unseal the outlet 50. The stripping of the sheet member is performed by turning a handle H (see a two-dot chain line in FIG. 2) connected detachably to the above-mentioned rotating shaft to wind the sheet member about the rotating shaft. Thus, the toner accommodated in the toner cartridge 4 is discharged from the outlet 50, and supplied into the development housing 2 through the outlet formed in the cover member 54 and the acceptance opening 10.

At the lower end peripheral edge of the toner cartridge 4 composed of the housing 52 and the lower cover member 54, a substantially rectangular flange portion is formed. The flange portion extending substantially horizontally and having a flat lower surface comprises a flange portion 56 extending in one side part in the width direction, a flange portion 58 extending in the other side part in the width direction, a flange portion 60 extending in a front part, and a flange portion 62 extending in a rear part. On the upper surface of the flange portion 56, two engaging protrusions 64 and 66 are formed with spacing in the front-to-back direction. The forward engaging protrusion 64 is formed at a lower level than the rearward engaging protrusion 66. The engaging protrusions 64 and 66 are formed slightly inward of the flange portion 56. On the upper surface of the flange portion 58, too, two engaging protrusions 70 and 72 are formed with spacing in the front-to-back direction. The forward engaging protrusion 70 is formed at a lower level than the rearward engaging protrusion 72. The engaging protrusions 70 and 72 are formed slightly inward of the flange portion 58.

In the middle in the width direction of the flange portion 62 extending in the rear part, a projection 61 is formed which projects rearward (see FIG. 2). This projection 61 has a rectangular engaged hole 63 (see FIGS. 2 and 16). With this engaged hole 63, the lock claw 44 mounted on the development housing 2 engages when the toner cartridge 4 is mounted on the development housing 2. Thus, the movement of the toner cartridge 4 in the releasing direction is inhibited.

The flange portion 56 of the so constituted toner cartridge 4 is moved forward along the guide groove 30 of the development housing 2, and the flange portion 58 of the toner cartridge 4 is likewise moved forward along the guide groove 32 of the development housing 2. Thereby, the toner cartridge 4 moves such that its lower surface traverses the upper end of the acceptance opening 10 of the development housing 2. Thus, the toner cartridge 4 is mounted removably on the development housing 2. The outlet 50 of the toner cartridge 4 is aligned with the acceptance opening 10. The lower engaging protrusion 64 of the flange portion 56 is contacted with the lower-level upper wall 35*a* of the guide groove 30, while the higher engaging protrusion 66 is contacted with the higher-level upper wall 35*b*. The lower engaging protrusion 70 of the flange portion 58 is contacted with the lower-level upper wall 38*a* of the guide groove 32, while the higher engaging protrusion 72 is contacted with the higher-level upper wall 38*b*. The flange portion 60 extending in the front part of the toner cartridge 4 is pressed against the seal member 29 disposed on the front wall 18. The flange portion 56 extending in one side part of the flange portion 60, the flange portion 58 extending in the other side part, and the flange portion 62 extending in the rear part, respectively, are brought into intimate contact with the upper surface portions 12, 14 and 16 of the development housing 2 via the seal members 20, 22 and 24.

When the toner cartridge 4 is mounted on the development housing 2 in the above-described manner, the lock claw 44 disposed in the development housing 2 is engaged with the engaged hole 63 of the toner cartridge 4 (see FIG. 16), whereby the movement of the toner cartridge 4 in the releasing direction is inhibited. Then, as has been described earlier, the outlet 50 of the toner cartridge 4 is unsealed to supply the toner in the toner cartridge 4 through the acceptance opening 10.

To allow the removal of the toner cartridge 4 mounted on the development housing 2, a shutter member 80 is used. With reference to FIGS. 6 to 12, the shutter member 80 which may be integrally molded from a suitable plastic material, such as ABS resin, is substantially rectangular when viewed from above. On the back of its peripheral edge part, a flange portion 82 is formed so as to extend in a substantially rectangular form when viewed from above. The flange portion 82 extends downward, and its height is constant. Of the flange portion 82, a flange portion 82*a* positioned at the front end extends linearly in the width direction, but has an inward concave 82*b* in the middle in the width direction thereof. This concave 82*b* is formed to avoid interference with the box portion 42 formed on the end wall 26 of the development housing 2 when the shutter member 80 is inserted between the toner cartridge 4 and the development housing 2, as will be described later on.

In one side part and the other side part in the width direction of the upper surface of the shutter member 80, guide grooves 84 and 86 are formed in a channel-like form. In a rear end part of the shutter member 80, a flange portion 87 extending upward is formed. The flange portion 87 extends linearly in the width direction, but has a rearwardly projecting projection 88 in the middle in the width direction thereof. This projection 88 is formed to avoid interference with the projection 61 of the toner cartridge 4 when the toner cartridge 4 is removed from the development housing 2 and accepted on the shutter member 80, as will be described later on. Near the projection 88 on the upper surface of the shutter member 80, a small engaging protrusion 89 is formed. This protrusion 89 is formed to releasably engage the engaged hole 63 formed in the projection 61 of the toner cartridge 4 when the toner cartridge 4 is accepted on the shutter member 80. By this measure, an operation for completely removing the toner cartridge 4 together with the shutter member 80 from the development housing 2 is smoothly performed as will be described later on. In the other side part of the flange portion 87, a grip portion 87*a* is formed for smoothly performing a turning operation for the shutter member 80 to be described later on. The grip portion 87*a* is formed by projecting the flange portion 87 rearward in a rectangular form, and has an upper surface and a rear surface each with a plurality of protuberances (see FIG. 12).

At the front end of one side part of the shutter member 80, a hook portion 90 is formed for constituting engaging means. The hook portion 90 is releasably engaged with the engaged hole 37 formed in the rear part of the side wall 34 of the development housing 2. The hook portion 90 protrudes forward from the top of the flange portion 82*a*, then extends laterally outward of the one side part, and further extends rearward (in a direction opposite to the inserting direction). On the inside of the rearwardly extending area of the hook portion 90, an inclined surface 90*a* is formed which corresponds to the inclined surface 39 formed in the engaged hole 37 (see FIG. 13). At the front end of the shutter member 80, an insertion portion 92 is further formed which protrudes forward substantially from the top of the flange portion 82*a* and extends widthwise. The insertion portion 92 defines the front end of the shutter member 80. The hook portion 90 and the insertion portion 92 comprise a plate-like portion formed so as to protrude forward and substantially horizontally from the upper end of the flange portion 82*a*. The insertion portion 92 has a lower surface inclined so as to ascend forward (in the inserting direction) (see FIGS. 11 and 12) in order to smoothly perform an inserting operation to be described later on.

On the flange portion 82*a* near the other side part in the width direction of the shutter member, an engaging piece 94 is formed which constitutes engaging means. As will be easily understood from FIGS. 6 and 12, the engaging piece 94 comprises a plate-like portion projecting forward and nearly horizontally from the flange portion 82*a*, and an upward engaging projection formed at the front end of the plate-like portion. The engaging piece 94 is releasably engaged with the notch 27 formed in the end wall 26 of the development housing 2 when the shutter member 80 is located at the operating position as will be described later on. The engaging projection is inclined in its front and rear surfaces for relatively easy engagement with and release from the notch 27.

The upper surface of the shutter member 80 bears a mark which indicates an operating procedure for locating the shutter member 80 at the operating position to be described later on. This mark comprises a first arrow 100 directed toward the hook portion 90, and a second arrow 102 headed in the direction of turning toward the inserting direction. The second arrow 102 is curved to show a turn. The arrows 100 and 102 are created by forming relatively shallow concaves in the shutter member 80 (see FIG. 10). In the first arrow 100, there is formed the number 1, a symbol showing that an operation for engaging the hook portion 90 with the engaged hole 37 of the development housing 2 should be performed in the first step. In the second arrow 102, there is formed the number 2, a symbol showing that an operation for turning the shutter member 80 in the inserting direction should be performed in the second step. These numbers 1 and 2 are formed from relatively low projections. These symbols may be symbols other than numerals, e.g., alphabets such as A and B. These symbols may also be formed not in the arrows 100 and 102, but near them. The upper surface of the shutter member 80 is formed in a substantially horizontal, flat form as a whole, except for the arrows 100 and 102 formed thereon, or other concaves (their explanations are omitted), the guide grooves 84 and 86 or the flange portion 87.

An explanation will be offered for the action of removing the toner cartridge 4, mounted on the development housing 2 as described earlier, from the development housing 2. With reference to FIG. 13, the hook portion 90 of the shutter member 80 is engaged with the engaged hole 37 of the development housing 2 in accordance with the arrow 100. This engaging operation is performed easily and smoothly by inserting the hook portion 90 between the flange portion 56 of the toner cartridge 4 and the upper surface portion 12 of the development housing 2. This area where the hook portion 90 is to be inserted is constituted to have none of the seal members 20 and 24 (see FIGS. 1 and 5). Thus, the inserting operation for the hook portion 90 is performed easily and smoothly. As shown by a two-dot chain line in FIG. 13, in engaging the hook portion 90 with the engaged hole 37, one side end of the shutter member 80 is contacted with the corner at the rear end of the side wall 34 of the development housing 2. With this site of contact as a fulcrum, the shutter member 80 is turned counterclockwise in FIG. 13 in accordance with the arrow 102. This facilitates a turning operation. This turning operation will become easier and smoother when performed using the grip portion 87*a* of the shutter member 80. When the inclined surface 90*a* of the hook portion 90 is engaged with the inclined surface 39 of the side wall 34, the entire shutter member 80 is pulled toward the side wall 34 of the development housing 2 along the inclined surface 39. Thus, the turn is promoted further, and the turning operation is performed smoothly.

As a result of this turn, the closest site to the most distant site, relative to the fulcrum, of the insertion portion 92, at the front end of the shutter member 80 is gradually inserted between the lower surface of the toner cartridge 4 and the upper surface portion of the development housing 2 (mainly, the upper surface portion 16) (more precisely, the seal member 24). Thus, the force of the inserting operation is markedly reduced, although the seal member 24 is elastically deformed. Moreover, the hook portion 90 is engaged with the engaged hole 37, and the shutter member 80 is turned about the engaged hole 37. Thus, the position of the shutter member 80 is regulated automatically properly, without the need to perform its alignment in the width direction relative to the development housing 2.

Figure 14:
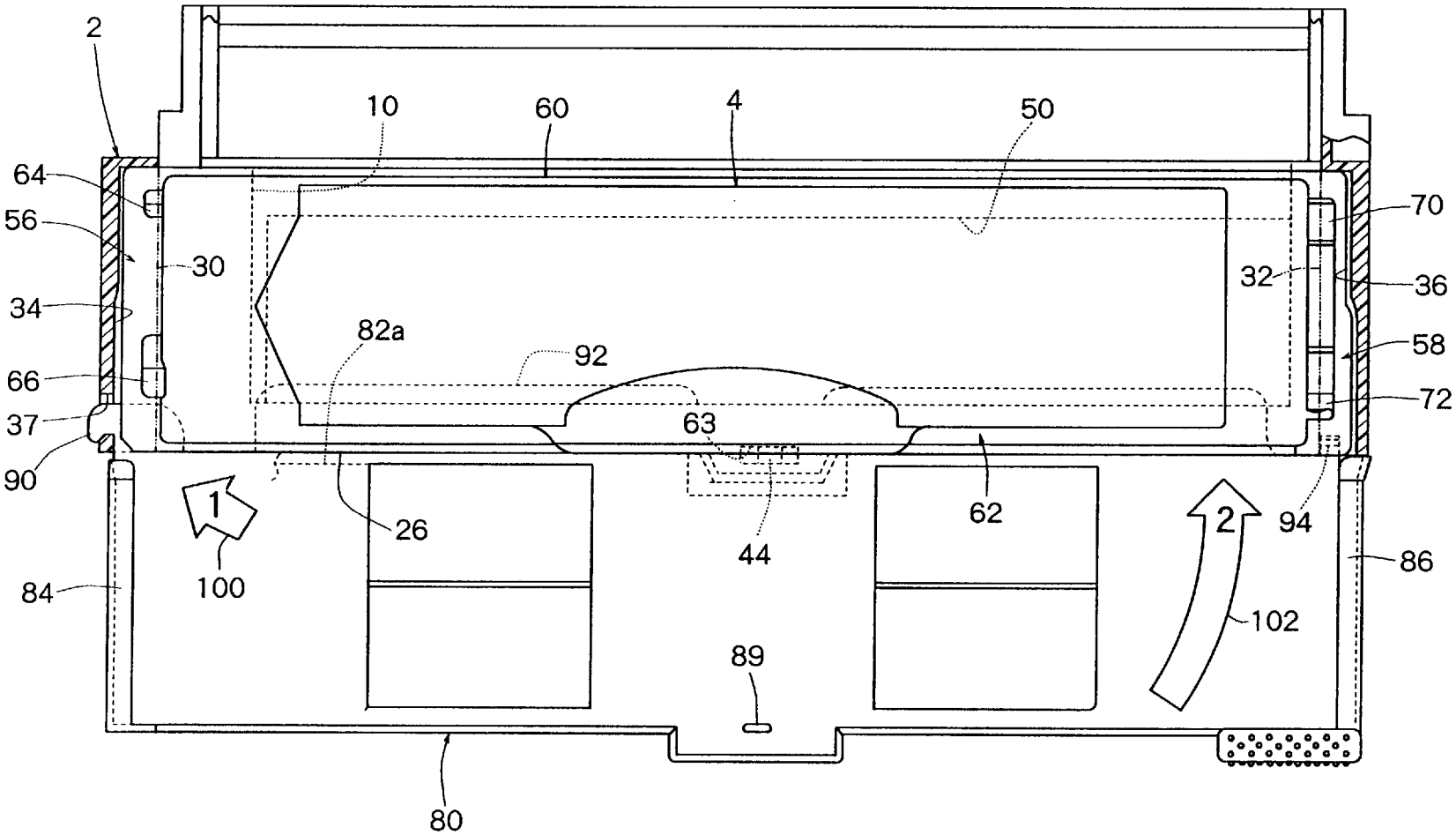
FIG. 14 is a plan view, partly broken away, showing a state in which the shutter member is located at an operation position relative to the development housing.
Figure 17:
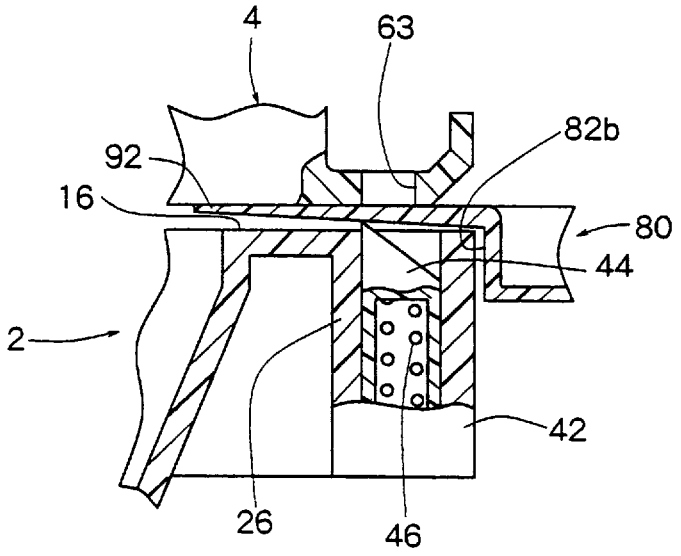
FIG. 17 is a sectional view showing a state in which the engagement between the lock claw member and the engaged hole is cleared by the shutter member.

The flange portion 82*a* formed at the front end of the shutter member 80 is contacted with the end wall 26 of the development housing 2, whereby the above-mentioned turn is inhibited. Thus, the mere execution of the turning operation ensures the reliable positioning of the shutter member 80 at the operating position (see FIGS. 14 and 15). Furthermore, one can easily make sure that the shutter member 80 has been located at the operating position, thus facilitating the inserting operation. In addition, the operating position of the shutter member 80, i.e., the insertion depth of the front end of the shutter member 80, can be confirmed even more easily. Hence, the release of the lock means is performed reliably. The insertion portion 92 of the shutter member 80 is inserted, over its entire width, between the lower surface of the toner cartridge 4 and the upper surface portion of the development housing 2. As indicated by a solid line in FIG. 13, the hook portion 90 is completely engaged with the engaged hole 37. During the turning operation in which the shutter member 80 is located at the operating position, the insertion portion 92 pushes the lock claw member 44 provided in the development housing 2 downward against the urging force of the spring 46. Thereby, the locking action on the toner cartridge 4 is cleared (see FIG. 17).

Figure 15:
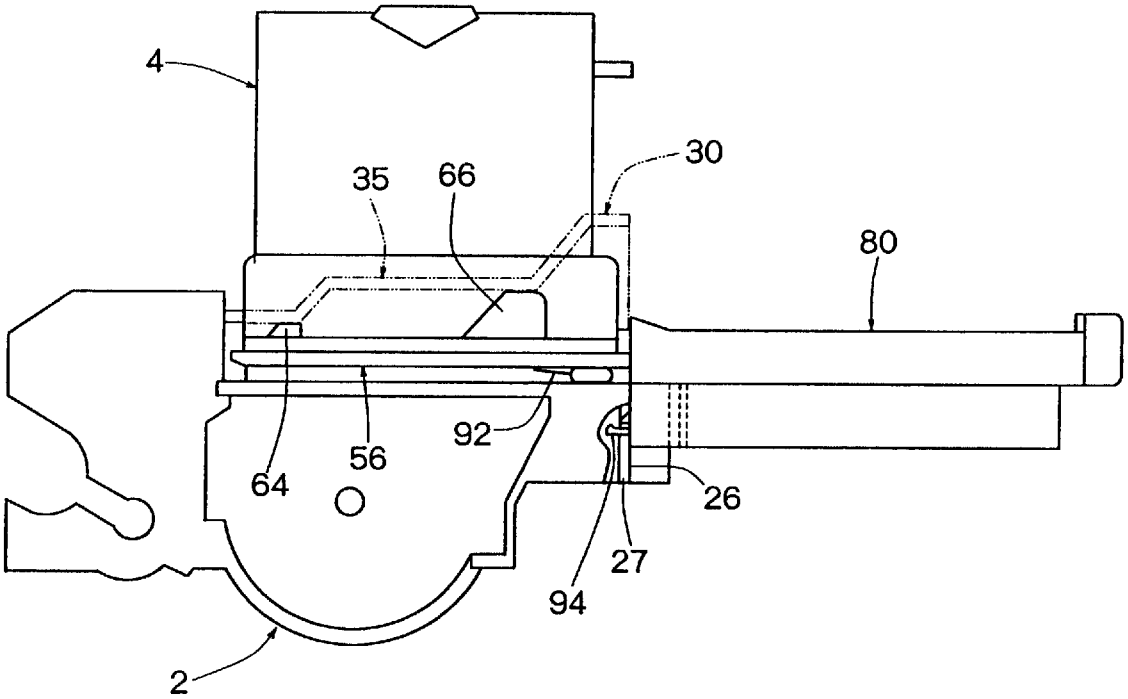
FIG. 15 is a side view, partly broken away, of FIG. 14 as viewed from the left.

When the shutter member 80 is brought to the operating position, moreover, the engaging piece 94 of the shutter member 80 is releasably engaged transiently with the notch 27 formed in the end wall 26 of the development housing 2 (FIG. 15). This is convenient because the positioning of the shutter member 80 at the operating position can be easily confirmed, and that makes it possible to perform the removal of the toner cartridge 4 (to be described later on) easily and precisely.

In the foregoing manner, the shutter member 80 is inserted between the lower surface of the toner cartridge 4 and the upper surface portion of the development housing 2 by the turning operation. Thus, a twist as in the prior art does not occur, and the inserting operation is carried out easily and smoothly.

As described previously, the upper surface of the shutter member 80 bears the first arrow 100 and the second arrow 102, the symbols showing the sequence of steps for positioning the shutter member 80 at the operating position. Hence, the sequence of steps to be done can be confirmed visually, and the engaging operation and the inserting operation (turning operation) can be performed easily and accurately.

Then, the toner cartridge 4 is withdrawn from the development housing 2, whereupon the flange portions 56 and 58 of the toner cartridge 4 are released from the guide grooves 30 and 32 of the development housing 2. Then, the toner cartridge 4 is guided by the guide grooves 84 and 86 of the shutter member 80 to be moved onto the shutter member 80. As noted earlier, the position of the shutter member 80 is temporarily restrained relative to the development housing 2, because the engaging piece 94 of the shutter member 80 is engaged with the notch 27 of the end wall 26 of the development housing 2. Thus, the above withdrawal, i.e. removal of the toner cartridge 4 from the development housing 2 can be performed easily and accurately in a stable manner.

The outlet 50 of the toner cartridge 4 is closed with the shutter member 80. The engaged hole 63 formed in the projection 61 of the toner cartridge 4 is releasably engaged with the engaging protrusion 89 of the shutter member 80. When, in this condition, the shutter member 80 is turned in a direction opposite to the aforementioned direction along with the toner cartridge 4, the engagement of the engaging piece 94 of the shutter member 80 with the notch 27 of the development housing 2 is released (since this engagement is relatively weak, it is released with a slight force). The turn is made until the inserting portion 92 of the shutter member 80 is removed from between the lower surface of the toner cartridge 4 and the upper surface portion of the development housing 2. Then, the engagement of the hook portion 90 with the engaged hole 37 is released, whereby the toner cartridge 4 is completely removed from the development housing 2 together with the shutter member 80, with the outlet 50 of the toner cartridge 4 being closed with the shutter member 80. Since the engaged hole 63 of the toner cartridge 4 is releasably engaged with the engaging protrusion 89 of the shutter member 80, the operation for removing the toner cartridge 4 from the development housing 2 integrally with the shutter member 80 is performed reliably and stably. Then, a different toner cartridge is mounted on the development housing 2 in the above-described manner, whereby toner cartridge replacement is carried out.

The preferred embodiments of the toner replenishing device constructed in accordance with the present invention have been described with reference to the accompanying drawings. However, it is to be understood that the invention is not limited thereto, but various changes and modifications may be made without departing from the spirit and scope of the invention. For example, the shutter member of the invention is applied not only to the toner replenishing device of the above-described type, but also to other types of toner replenishing devices, such as a toner replenishing device of the type in which a toner cartridge is removably mounted on a toner hopper (container) located at a position apart from a development housing. In the above-described embodiments, the hook portion 90, i.e., engaging means, is formed in the shutter member 80, while the engaged hole 37, i.e., engaged means, is formed in the development housing 2, but they may be formed vice versa. Furthermore, the engaging piece 94, other engaging means, is formed in the shutter member 80, while the notch 27, other engaged means, is formed in the end wall 26 of the development housing 2; however, they may be formed vice versa.

What I claim is:

1. A toner replenishing device comprising a container having an acceptance opening for a toner; and a toner cartridge removably mounted on said container so as to traverse the acceptance opening along an upper surface portion extending at the upper end of the acceptance opening, and having an outlet for supplying a toner accommodated therein into said container through the acceptance opening;

said container having stop means disposed thereon for inhibiting said toner cartridge mounted on said container from being released from said container, said stop means being disposed so as to protrude upward from the upper surface portion at the upstream end in the mounting direction of said toner cartridge;

said toner replenishing device further including a shutter member constituted such that when said toner cartridge is to be removed from said container, a front end of said shutter member is inserted between the lower surface of said toner cartridge and the upper surface portion of said container to bring said shutter member to an operating position, thereby clearing the action of the stop means, permitting the removal of said toner cartridge while closing the outlet of said toner cartridge; wherein one of engaging means and engaged means to be releasably engaged with each other is formed for making said shutter member turnable in the inserting direction and in the reverse direction and for regulating the widthwise position of said shutter member relative to said container, said one of the engaging means and the engaged means being disposed in one side part of the upstream end of said container in the mounting direction of said toner cartridge, and the other of the engaging means and the engaged means is formed in one side part of the front end of the shutter member in the inserting direction.

2. The toner replenishing device of claim 1, wherein a side wall extending vertically is formed in the one side part of said container, the engaged means is formed in the upstream end part of the side wall, the engaged means comprises an engaged hole, the engaging means is formed in the one side part of said shutter member, and the engaging means comprises a hook portion extending laterally outward of the one side part and then extending in a direction opposite to the inserting direction.

3. The toner replenishing device of claim 2, wherein said container has an end wall formed so as to extend downward from the upper surface portion in an upstream end part in the mounting direction of said toner cartridge and extend in the width direction; at sites in the inserting direction of said shutter member, excluding the hook portion and the front end part to be inserted between the lower surface of said toner cartridge and the upper surface portion of said container, a flange portion extending downward is formed so as to extend in the width direction; the hook portion and the front end part each comprise a plate-like portion formed so as to protrude forward and substantially horizontally from the upper end of the flange portion; and the operating position of said shutter member is regulated by the contact of the flange portion with the end wall.

4. The toner replenishing device of claim 1, wherein the upper surface of said shutter member bears a mark showing the sequence of steps for positioning said shutter member at the operating position.

5. The toner replenishing device of claim 4, wherein the mark comprises a first arrow directed toward the other of the engaging means and the engaged means, and a second arrow headed in the direction of turning toward the inserting direction; in the first arrow or nearby, a symbol is formed for showing that an operation for engaging the other of the engaging means and the engaged means with the one of the engaging means and the engaged means should be performed in the first step; and in the second arrow or nearby, a symbol is formed for showing that an operation for turning said shutter member in the inserting direction should be performed in the second step.

6. The toner replenishing device of claim 1, wherein one of other engaging means and other engaged means to be releasably engaged with each other is formed near the other side part of the upstream end of said container in the mounting direction of said toner cartridge, and the other of the other engaging means and the other engaged means is formed in the other side part of the front end of said shutter member in the inserting direction, said other of the other engaging means and the other engaged means being engaged with the one of the other engaging means and the other engaged means to temporarily inhibit the turn from the operating position in the direction opposite to the inserting direction, thereby positioning the shutter member at the operating position.

7. A shutter member in a toner replenishing device, said toner replenishing device comprising a container having an acceptance opening for a toner; and a toner cartridge removably mounted on the container so as to traverse the acceptance opening along an upper surface portion extending at the upper end of the acceptance opening, and having an outlet for supplying a toner accommodated therein into the container through the acceptance opening; said container having stop means disposed thereon for inhibiting the toner cartridge mounted on the container from being released from the container, said stop means being disposed so as to protrude upward from the upper surface portion at the upstream end in the mounting direction of the toner cartridge;

said shutter member being constituted such that when the toner cartridge is to be removed from the container, a front end of said shutter member is inserted between the lower surface of the toner cartridge and the upper surface portion of the container to bring said shutter member to an operating position, thereby clearing the action of the stop means, permitting the removal of the toner cartridge while closing the outlet of the toner cartridge;

one of engaging means and engaged means to be releasably engaged with each other being formed in one side part of the upstream end of the container in the mounting direction of the toner cartridge; wherein the other of the engaging means and engaged means is formed in one side part of the front end of said shutter member in the inserting direction, and is engaged with the one of the engaging means and engaged means to make said shutter member turnable in the inserting direction and in the reverse direction and regulate the widthwise position of said shutter member relative to the container.

8. The shutter member of claim 7, wherein the engaging means is formed in the one side part of said shutter member, the engaging means comprises a hook portion extending laterally outward of the one side part and then extending in a direction opposite to the inserting direction, and the hook portion is releasably engaged with an engaged hole which is formed in the upstream end part of the side wall disposed so as to extend vertically in the one side part of the container and which defines the engaged means.

9. The shutter member of claim 8, wherein at sites in the inserting direction of said shutter member, excluding the hook portion and the front end part to be inserted between the lower surface of the toner cartridge and the upper surface portion of the container, a flange portion extending downward is formed so as to extend in the width direction; the hook portion and the front end part each comprise a plate-like portion formed so as to protrude forward and substantially horizontally from the upper end of the flange portion; and the operating position of said shutter member is regulated by the contact of the flange portion with an end wall formed so as to extend downward from the upper surface portion in an upstream end part of the container in the mounting direction of the toner cartridge and extend in the width direction.

10. The shutter member of claim 7, wherein the upper surface of said shutter member bears a mark showing the sequence of steps for positioning said shutter member at the operating position.

11. The shutter member of claim 10, wherein the mark comprises a first arrow directed toward the other of the engaging means and the engaged means, and a second arrow headed in the direction of turning toward the inserting direction; in the first arrow or nearby, a symbol is formed for showing that an operation for engaging the other of the engaging means and the engaged means with the one of the engaging means and the engaged means should be performed in the first step; and in the second arrow or nearby, a symbol is formed for showing that an operation for turning said shutter member in the inserting direction should be performed in the second step.

12. The shutter member of claim 7, wherein one of other engaging means and other engaged means to be releasably engaged with each other is formed in the other side part of the front end of said shutter member in the inserting direction, said one of the other engaging means and the other engaged means is engaged with the other of the other engaging means and the other engaged means formed near the other side part of the upstream end of the container in the mounting direction of the toner cartridge, whereby said one of the other engaging means and the other engaged means temporarily inhibits the turn of said shutter member from the operating position in the direction opposite to the inserting direction, thereby positioning said shutter member at the operating position.

13. A toner cartridge mounted on a container, said container having an acceptance opening for a toner and stop means disposed so as to protrude upward from an upper surface portion at one end site of the upper surface portion extending at the upper end of the acceptance opening, said container also having one of engaging means and engaged means to be engaged with each other releasably; said one of the engaging means and the engaged means making a shutter member turnable in an inserting direction toward the upper surface portion of the container and along it, and in the reverse direction, and regulating the position of said shutter member in the width direction relative to the container; said shutter member being prepared as a member separate from the container, and having the other of the engaging means and engaged means formed in one side part thereof, said one of the engaging means and engaged means being formed in one side part of the container opposed to the one side part of the shutter member, said toner cartridge being removably mounted on the container so as to traverse the acceptance opening along the upper surface portion of the container, being inhibited by the stop means from being released from the container, and having an outlet for supplying a toner accommodated therein into the container through the acceptance opening, wherein said toner cartridge has a lower surface opposed to the upper surface portion of the container when mounted on the container, when the shutter member is turned in the inserting direction to an operating position at which a front end of the shutter member is inserted between the lower surface of said toner cartridge and the upper surface portion of the container, the action of the stop means is cleared so that said toner cartridge can be pulled out onto the shutter member, and when said toner cartridge is pulled out onto the shutter member, said toner cartridge is turned in a direction opposite to the inserting direction, along with the shutter member, and removed from the container, with the outlet of said toner cartridge being closed.

14. The toner cartridge of claim 13, wherein an engaged hole is formed to be releasably engaged with the stop means of the container, and the engaged hole is releasably engaged with an engaging protrusion formed on the shutter member in the condition in which the toner cartridge is withdrawn onto the shutter member and the outlet is closed.

* * * * *